United States Patent [19]

Hanson

[11] Patent Number: 4,512,295

[45] Date of Patent: Apr. 23, 1985

[54] DIESEL GLOW PLUG TIP ENLARGEMENT PROTECTION

[75] Inventor: Jay L. Hanson, Bloomington, Minn.

[73] Assignee: Thermo King Corporation, Minneapolis, Minn.

[21] Appl. No.: 450,858

[22] Filed: Dec. 17, 1982

[51] Int. Cl.[3] ..... F02P 19/02

[52] U.S. Cl. ..... 123/145 A; 123/179 BG; 123/179 H; 219/202; 219/205; 219/494; 219/512

[58] Field of Search ..... 123/145 A, 179 BG, 179 H, 123/179 B; 219/483, 494, 512, 510, 205, 202, 486

[56] References Cited

U.S. PATENT DOCUMENTS 2,178,659 11/1939 White ..... 123/145
4,177,785 12/1979 Sundeen ..... 123/179 H
4,280,452 7/1981 Kawamura et al. ..... 123/179 BG
4,319,126 3/1982 Lujic ..... 219/494
4,322,604 3/1982 Kawamura et al. ..... 123/145 A

FOREIGN PATENT DOCUMENTS 636543 2/1962 Canada ..... 219/494
2356605 5/1975 Fed. Rep. of Germany ... 123/145 A

*Primary Examiner*—Andrew M. Dolinar
*Attorney, Agent, or Firm*—E. C. Arenz

[57] ABSTRACT

The tips 14 of any glow plugs 10 which are shorted are protected against enlargement by a separate protective device 28 in each series connection 26 to an individual glow plug opening in a fraction of a second in response to current through the device of a value corresponding to a short of the heating element in the tip.

6 Claims, 5 Drawing Figures

DIESEL GLOW PLUG TIP ENLARGEMENT PROTECTION

BACKGROUND OF THE INVENTION

This invention pertains to the art of diesel engines generally, and in particular to protective arrangements for diesel engine glow plugs.

Many diesel engines are provided with glow plugs which are particularly useful in cold weather to aid in starting the diesel engine. One typical protection arrangement is to connect the glow plugs in parallel and in series with a single fuse link.

It has been the experience of the assignee of this invention that, in connection with its product, i.e., transport refrigeration units using diesel engine prime movers, some operators of the units will use a remote power source to aid in obtaining a start in severely cold weather. Sometimes a twelve volt battery will be connected in series with the twelve volt battery for the engine. At other times a remote starter-generator may be connected to the glow plug circuit and, depending upon the setting of the starter-generator, significantly greater voltage than the nominal twelve volts may be applied to the glow plugs. The application of the voltages higher than the nominal twelve volts may result in fuse link burnout or, alternatively and sometimes more seriously, enlargement of the tip or tips of one or more glow plugs. The reason the enlargement of the glow plug tip may be more serious than the burnout of a fuse link is that the tip of the glow plug may enlarge to a degree that the plug may not be able to be removed from the engine without stripping off the end of the glow plug and the engine head must then be removed to extract the particle(s).

It is the aim of this invention to provide an arrangement to prevent enlargement of glow plug tips under a condition of either an overvoltage being applied to the glow plugs, or under a nominal voltage condition.

The invention is premised in part upon the observation that ordinarily a glow plug blowout follows a short in the glow plug tip. The time period between the shorting of a glow plug tip and its enlargement will vary in accordance with a number of factors or conditions. By relatively quickly interrupting the circuit to the shorted glow plug, as in a fraction of a second, glow plug tip enlargement can be prevented.

SUMMARY OF THE INVENTION

In accordance with the invention, the arrangement for preventing enlargement of the glow plug tip, after a short of the heating element, includes a separate series connection for energizing each individual glow plug, and a separate, cyclable circuit interruption means in each of the series connections operable to open the connection within a fraction of a second in response to current through the interruption means being of a value corresponding to a short of the heating element in the tip.

In the preferred embodiment, the circuit interruption means comprises a self-heating bimetal switch in an outer envelope, with the envelope being encapsulated with potting compound to provide a thermal lag to increase the time during which a non-shorted heating element is energized and heating before the switch opens, when an overvoltage is being applied.

DESCRIPTION OF THE PREFERRED EMBODIMENT

Figure 1:
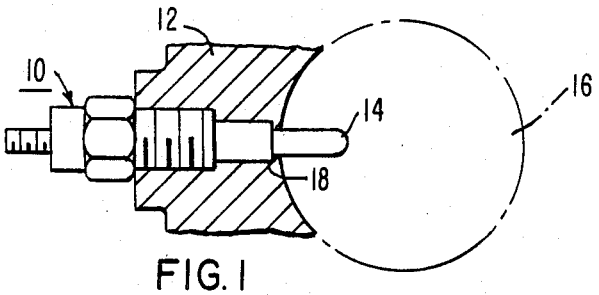
FIG. 1 is a cross-sectional view of a fragment of the cylinder head with a typical glow plug installed therein.

In FIG. 1 a typical glow plug 10 is shown seated in a bore of the cylinder head 12 with the tip 14 of the plug projecting into swirl chamber 16 which is in communication with a combustion chamber of the diesel engine. It is the tip 14 which is subject to being enlarged after a short occurs in the heating element, resulting in an enlargement in diameter of the tip sheath. The problem in removing the plug after this occurs is that the final step of the bore in the head has a diameter which is essentially that of the tip 14 since the shoulder at 18 of the plug is intended to seal against the facing shoulder of the bore which accommodates the tip.

Figure 2:
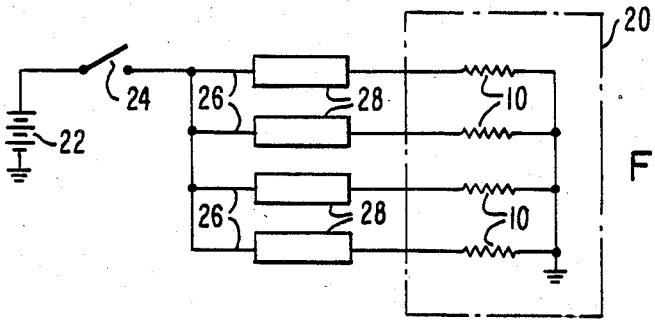
FIG. 2 is a schematic view of the circuit arrangement for heating the glow plugs.

In FIG. 2 the diesel engine 20 is diagrammatically illustrated including a cylinder head into which the individual glow plugs 10 are inserted, with one for each cylinder. The battery 22 of nominal 12 volt voltage, serves as the power source through an on/off switch 24 to the separate connections 26 to each of the individual glow plugs. Each separate series connection 26 includes a separate circuit interruption means 28 in accordance with the invention.

Figure 3:
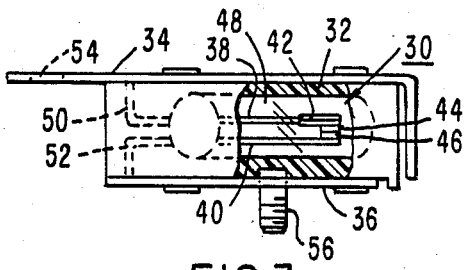
FIG. 3 is a partly-broken top view of one currently preferred bimetal switch and mounting arrangement, this particular design being contributed to in part by others.
Figure 4:
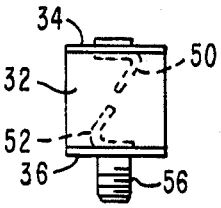
FIG. 4 is an end view of the device of FIG. 3.
Figure 5:
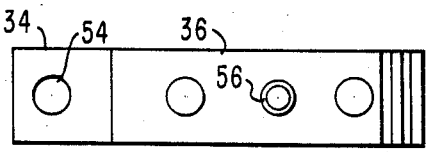
FIG. 5 is a side view of the device.

The currently preferred form of circuit interruption device is shown in FIGS. 3–5 and basically comprises a self-heating bi-metal switch generally designated 30 and arranged in an assembly with a potting compound, such as an epoxy fill 32, and opposite terminal members 34 and 36.

The bimetal switch of this example includes a pair of leaf elements 38 and 40, the leaf 38 carrying a bimetallic strip 42 which in turn carries contact 44 which is in facing relation with the contact 46 at the end of leaf 40. These leaves are encased in an evacuated outer glass envelope 48 and one lead 50 connected to leaf 38 exits the envelope and is electrically connected to and mechanically secured to the terminal plate 34. The lead 52 connected to leaf 40, similarly exits the envelope and is secured to the opposite terminal plate 36. The entirety of the space surrounding the envelope 48 and between the two terminal plates is filled with epoxy. Terminal plate 34 is provided with a hole 54 (FIG. 5) adapted to receive the end terminal of a glow plug and be secured thereto to provide the electrical connection to, and a mechanical mount between, the glow plug and switch. The terminal plate 36 has a threaded stud 56 mechanically and electrically secured thereto so that each of the protective devices can be connected to power as by a bus bar or the like.

The bimetal switch 30 is commercially available as Sylvania SB717C1H of GTE Products Corporation. Its basic specifications are that it will trip at eight amps in between 10 to 60 seconds, and will trip with no current at 160° C. plus or minus 10° C., and will reset with no current at 50° C. minimum with a 10° C. minimum differential.

The character of the bimetal switch is such that with normal voltage from a single twelve volt battery and a good glow plug, the switch does not open. However, with nominal battery voltage and a short in the heating element, the high current through the particular switch serving the glow plug will cause the switch to open in a sufficiently short time that tip enlargement is prevented.

Encasing the bimetal switch in the potting compound 32 not only provides shielding protection from the environment around the diesel engine, but also provides a thermal lag which aids in the initial startup when an overvoltage is applied by allowing the glow plug to heat to a normal operating temperature before the switch starts to cycle. Without the thermal lag, and with an overvoltage, the switch would normally open before the plug tip heated to normal operating temperature. It is noted that the protective devices are located in the space near the diesel engine and as such are subject to ambient temperature changes at those locations. Since bimetallic strips are inherently temperature responsive, a lower ambient temperature will cause the contacts to stay closed longer than when the ambient is warmer. This effectively compensates for glow plug on-time requirements.

A cycling life test of a protective device connected to a good glow plug with 30 volts applied resulted in failure of the protective device after about 35,000 cycles, but with no failure of the glow plug.

As has been noted before, blowout of a glow plug tip is almost always proceeded by a short in the heating element. While the time period from a short to a tip sheath enlargement will vary, by opening the bimetal switch in a very short time such as a fraction of a second, enlargement in almost all instances will be prevented. Thus the switch is selected to have a hysteresis of the bimetal strip which is such that it will operate to open within a fraction of a second in response to current through the switch being of a value corresponding to a shorted heating element.

The bimetal switch is characterized herein as being self-heating to distinguish this type of switch, which has the bimetallic strip heated by the current in the circuit which it is to interrupt upon sufficient heating, from those bimetal switches in which the heater for the bimetal strip is in a separate circuit.

What I claim is:

1. For a diesel engine having at least one glow plug means including glow plug tip means adapted to be electrically energized for heating the glow plug tip means, an arrangement for preventing enlargement of the tip means after a short of the tip means, comprising:

a separate series connection for energizing each of one or more of said glow plug means; and a separate, cyclable circuit interruption means in each said series connection operable to open said connection within a fraction of a second in response to current through said interruption means of a value corresponding to a short of said tip means.

2. An arrangement according to claim 1 wherein:

said circuit interruption means comprises a self-heating bimetal switch.

3. An arrangement according to claim 2 wherein:

said bimetal switch includes an outer envelope; and means encapsulating said envelope to provide a thermal lag to increase the time of heating said heating element, in a normal condition of said tip means, before said switch opens.

4. An arrangement according to claim 3 wherein:

said encapsulating means is exposed to ambient temperatures near said engine.

5. An arrangement for protecting against glow plug tip blowout for a diesel engine having one or more glow plugs and including means for energizing the one or more glow plugs, comprising:

a separate series connection between said energizing means and each of said one or more plugs;

a self-heating bimetal element in series in each said connection to a glow plug, said bimetal element being of a character as to heat and open the series connection in a fraction of a second under a condition of said glow plug tip being shorted.

6. An arrangement according to claim 5 including:

means encasing said bimetal element to provide a thermal lag to increase the time period of heating said glow plug tip in a non-shorted condition before said bimetal switch element opens.

* * * * *